US012497885B1

(12) United States Patent
Wang et al.

(10) Patent No.: US 12,497,885 B1
(45) Date of Patent: Dec. 16, 2025

(54) SCALE CONTROL IN OILFIELD PRODUCED WATERS

(71) Applicant: Saudi Arabian Oil Company, Dhahran (SA)

(72) Inventors: Qiwei Wang, Dhahran (SA); Tao Chen, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/812,290

(22) Filed: Aug. 22, 2024

(51) Int. Cl.
*E21B 43/40* (2006.01)
*E21B 37/06* (2006.01)
*E21B 43/16* (2006.01)

(52) U.S. Cl.
CPC ..... *E21B 43/40* (2013.01); *E21B 37/06* (2013.01); *E21B 43/164* (2013.01)

(58) Field of Classification Search
CPC .. E21B 47/138; E21B 49/005; E21B 41/0064; E21B 47/00; E21B 47/07; E21B 41/0057; E21B 47/103; E21B 43/40; E21B 37/06
See application file for complete search history.

(56) References Cited

U.S. PATENT DOCUMENTS 7,255,794 B2 * 8/2007 Max ..... B01D 53/62 210/906
11,230,473 B2 1/2022 Sant et al.
2016/0168985 A1 * 6/2016 Betancourt-Pocaterra ..... E21B 49/005 73/152.04
2021/0356680 A1 11/2021 Constantz et al.

OTHER PUBLICATIONS

Jordan, "Management of Scale Control in Produced Water Reinjection—The Near Wellbore Scale Challenge Overcome," SPE-190713-MS, presented at the SPE International Oilfield Scale Conference and Exhibition, Aberdeen, Scotland, UK, Jun. 20-21, 2018, 21 pages.
Kermani et al., "Chemical solutions for restoring scaling-induced injectivity impairment in offshore produced water re-injection," Science of The Total Environment, Dec. 2023, 903:166597, 18 pages.

(Continued)

*Primary Examiner* — Zakiya W Bates
(74) *Attorney, Agent, or Firm* — Fish & Richardson P.C.

(57) ABSTRACT

Systems and methods include scale control in oilfield produced waters. Thermodynamic data indicative of surface conditions and subterranean conditions of a subterranean region including a well is received, from probes. An acidity of a produced water stream to be disposed in the well is received from a pH meter. A supersaturation degree of the produced water stream to be disposed in the well is determined, by using the thermodynamic data. An amount of carbon dioxide to be injected in the produced water stream to neutralize a scaling risk is determined, by the one or more processors, by using the supersaturation degree and the acidity. An injection of the amount of the carbon dioxide in the produced water stream is triggered to neutralize the scaling risk.

8 Claims, 9 Drawing Sheets

(56) References Cited

OTHER PUBLICATIONS

Moghadasi et al., "Formation Damage Due to Scale Formation in Porous Media Resulting from Water Injection," SPE-86524-MS, presented at the SPE International Symposium and Exhibition on Formation Damage Control, Lafayette, Louisiana, Feb. 18-20, 2004, 11 pages.

Ragulin et al., "Scale Management of Production Wells via Inhibitor Application in Supporting Injection Wells," SPE-87461-MS, presented at the SPE International Symposium on Oilfield Scale, Aberdeen, United Kingdom, May 26-27, 2004, 8 pages.

* cited by examiner

200A

200B

200D

SCALE CONTROL IN OILFIELD PRODUCED WATERS

TECHNICAL FIELD

This disclosure relates to scale control in oilfield produced waters and, more specifically, to injecting a predetermined amount of carbon dioxide ($CO_2$) into produced water obtained from a water oil separator.

BACKGROUND

The calcium carbonate ($CaCO_3$) scaling process appears when produced water (PW) is injected underground either for disposal or reinjection to enhance oil recovery. The PW is prone to $CaCO_3$ scaling, especially within carbonate reservoirs. Continuous injection of threshold scale inhibitor is a common practice to prevent calcium carbonate $CaCO_3$ scale formation in oilfield produced water for reinjection and underground disposal. The applied inhibitor is gradually removed by the reservoir rock when the produced water crosses through the porous reservoir formation, leaving the water under-protected or unprotected from scale formation. Well injectivity can be affected by scale formation in oilfield produces waters. Scale control can be managed to avoid technical challenges including scale formation, chemical inhibition, compatibility issues, removal difficulties, and other potential detrimental environmental effects.

SUMMARY

Implementations of the present disclosure are directed to scale control in oilfield produced waters. More particularly, implementations of the present disclosure are directed to injection of carbon dioxide ($CO_2$) into produced water obtained from a water oil separator.

In some implementations, a method includes: receiving, by one or more processors from probes, thermodynamic data indicative of surface conditions and subterranean conditions of a subterranean region including a well; receiving, by the one or more processors from a pH meter, an acidity of a produced water stream to be disposed in the well; determining, by the one or more processors, by using the thermodynamic data, a supersaturation degree of the produced water stream to be disposed in the well; determining, by the one or more processors, by using the supersaturation degree and the acidity, an amount of carbon dioxide to be injected in the produced water stream to neutralize a scaling risk; and triggering, by the one or more processors, an injection of the amount of the carbon dioxide in the produced water stream to neutralize the scaling risk.

The foregoing and other implementations can each optionally include one or more of the following features, alone or in combination. In particular, implementations can include all the following features:

In a first aspect, combinable with any of the previous aspects, wherein determining the supersaturation degree of the produced water stream includes determining a saturation ratio of the fluid. In another aspect, combinable with any of the previous aspects, probe data includes temperature, pressure data, and flow data. In another aspect, combinable with any of the previous aspects, the pH meter is located at least about 60 meters after a mixture point. In another aspect, combinable with any of the previous aspects, the scaling risk includes formation of calcium carbonate. In another aspect, combinable with any of the previous aspects, the amount of the carbon dioxide is injected in the produced water stream in a liquid phase or a supercritical phase. In another aspect, combinable with any of the previous aspects, the produced water stream is filtered to remove oil and heavy particles. In another aspect, combinable with any of the previous aspects, the produced water stream includes ion components including sodium ($Na^+$), chloride ($Cl^-$), calcium ($Ca^{2+}$), magnesium ($Mg^{2+}$), bicarbonate ($HCO^{3-}$), and sulfate ($SO_4^{2-}$).

Other implementations of the aspect include corresponding systems, apparatus, and computer programs, configured to perform the actions of the methods, encoded on computer storage devices.

The present disclosure also provides a computer-readable storage medium coupled to one or more processors and having instructions stored thereon which, when executed by the one or more processors, cause the one or more processors to perform operations in accordance with implementations of the methods provided herein.

The present disclosure further provides a system for implementing the methods provided herein. The system includes one or more processors, and a computer-readable storage medium coupled to the one or more processors having instructions stored thereon which, when executed by the one or more processors, cause the one or more processors to perform operations in accordance with implementations of the methods provided herein.

It is appreciated that methods in accordance with the present disclosure can include any combination of the aspects and features described herein. That is, methods in accordance with the present disclosure are not limited to the combinations of aspects and features specifically described herein, but also include any combination of the aspects and features provided.

Implementations described in the present disclosure, provide multiple technical advantages. For example, the $CaCO_3$ scale control described in the present disclosure is based on utilizing $CO_2$ for decarbonization according to thermodynamic models adjusted based on measured thermodynamic conditions, rather than ignoring removal of the applied inhibitor, which can lead to significant errors in scaling control, damaging injectivity. Configurations of the thermodynamic models can be adjusted to reflect field characteristics (e.g., characteristics of reservoirs and wells) relative to real-time recorded thermodynamic conditions, protecting well injectivity according to respective safety standards. Another advantage of the described technology is that it eliminates the use of toxic chemicals for scale removal, minimizing environmental risks. Furthermore, the described approach allows a continuous adjustment of the volume of injected $CO_2$ to control $CaCO_3$ scale to maximize safe disposal of oilfield produced water.

The details of one or more implementations of the subject matter of the specification are set forth in the accompanying drawings and the description below. Other features, aspects, and advantages of the subject matter can become apparent from the description, the drawings, and the claims.

DESCRIPTION OF DRAWINGS

The accompanying drawings, which are incorporated in and constitute a part of this specification, show particular aspects of the subject matter disclosed herein and, together with the description, help explain some of the principles associated with the disclosed implementations. In the drawings.

Figure 1A:
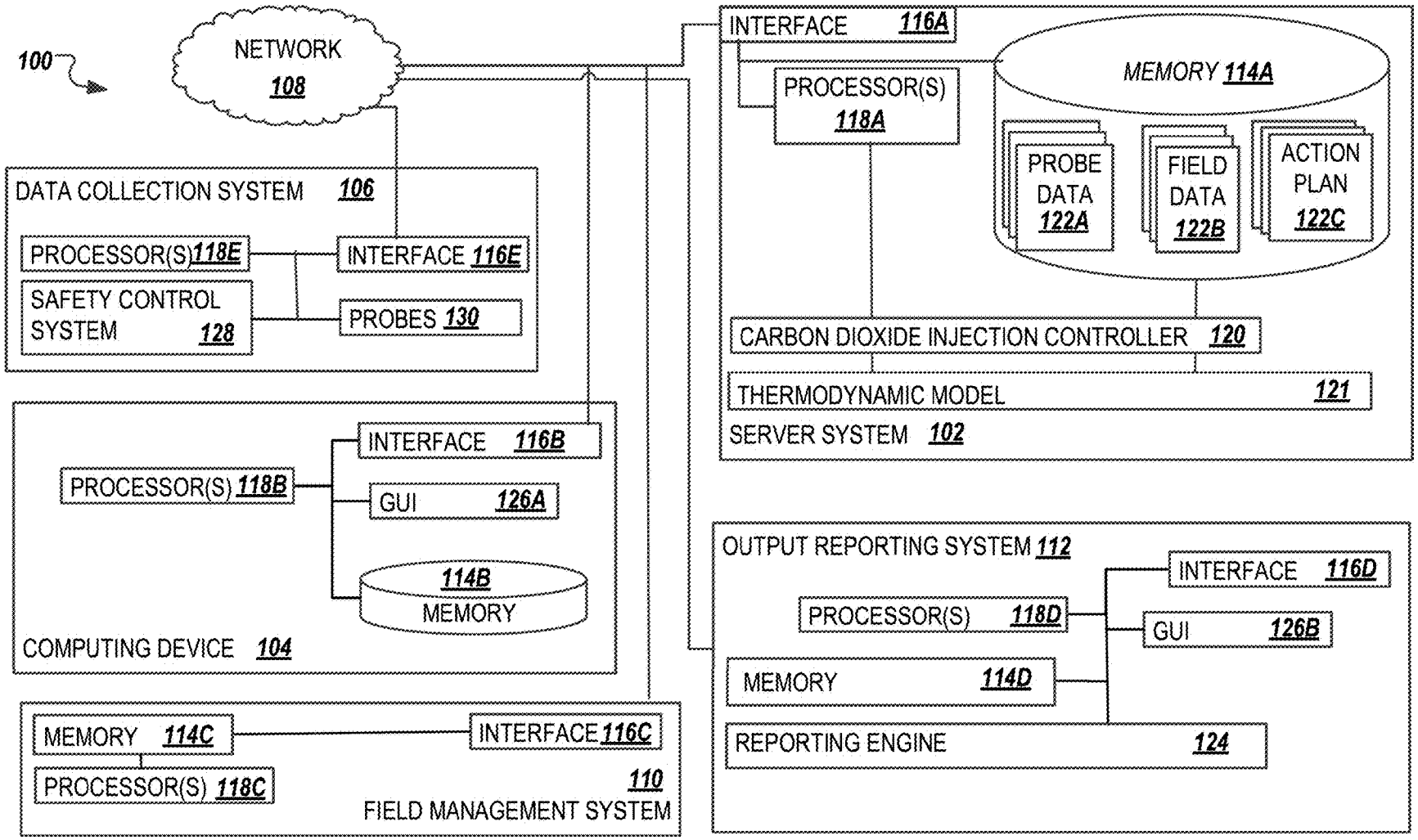
FIG. 1A is a block diagram of an example system that can be used to execute implementations of the present disclosure.

When practical, like labels are used to refer to same or similar items in the drawings.

DETAILED DESCRIPTION

Implementations of the present disclosure are directed to scale control in disposal of oilfield produced waters. More particularly, implementations of the present disclosure are directed to adjusted injection of carbon dioxide ($CO_2$) into produced water obtained from a water oil separator. The adjustment of $CO_2$ injection is based on measured thermodynamic parameters. The thermodynamic parameters can be measured by a pH meter and probes that can be attached to or integrated in reinjection or disposal wells. The probes collect data including water flow rate, reservoir temperature, and pressure indicative of thermodynamic conditions. The probe data can be provided as input to automatically update thermodynamic models. The thermodynamic models represent characteristics of reinjection or disposal wells in relation to $CO_2$ injection and scaling control. The measured thermodynamic parameters are used to adjust the characteristics of the thermodynamic models of the reinjection or disposal wells to adjust $CO_2$ injection for scaling control.

Scaling control has been used at oil and gas facilities that produce large volumes of water as a by-product of the hydrocarbon extraction process. Injection of oilfield produced water to underground is often necessary since the dissolved substances in the brine represent a potential hazard to surface water and shallow groundwater. Reinjection of the oilfield produced water includes pumping the fluids back into the subterranean formation, from which they originated or into a formation with similar reservoir characteristics and water quality. The employed disposal method for the oilfield produced water maximizes the rate at which oilfield produced liquid can be disposed, while simultaneously minimizing aboveground handling and the potential for accidental release. The oilfield produced water is also often being injected into separate deep, saline water-bearing rock formations for disposal. The oilfield produced water can contain high levels of dissolved salts originating from seawater and increasing in concentration due to evaporation and precipitation. Due to the associated processes, the oilfield produced water includes most seawater ion components. For example, the oilfield produced water can include sodium ($Na^+$), chloride ($Cl^-$), calcium ($Ca^{2+}$), magnesium ($Mg^{2+}$), bicarbonate ($HCO^{3-}$), and sulfate ($SO_4^{2-}$) ions. The ions within the oilfield produced water can be supersaturated with respect to calcium carbonate ($CaCO_3$) presenting a high risk of scaling (formation of $CaCO_3$) during produced water reinjection or disposal.

Traditionally, the risk of scaling was decreased by using threshold scale inhibition chemicals that can prevent the formation of inorganic scale (including $CaCO_3$), most often in the treatment dosage of 5-25 parts per million (ppm). The active ingredient of the scale inhibition chemicals is phosphonates, phosphate esters, or small molecule polymers (with molecular weight smaller than approximately 5,000 in most cases). The scale inhibition chemicals are kinetic inhibitors that can delay the scaling process. The higher the inhibitor concentration, the longer the scaling process can be delayed. The scale inhibition chemicals are surface active molecules that can form strong bonds with inorganic minerals such as carbonate, sulfate, and clays. The treated produced water (with scale inhibitor added) can be injected into reservoir formation (either in disposal wells or oil-bearing rock layers for water flooding), such that the added scale inhibitors can react with the formation rocks and retained on the rock surface. A disadvantage of the scale inhibitor is related to its limitation to travel with water, being stripped from the water gradually as water travels in the porous formation rocks. The formation rocks can be either carbonate (limestone, dolomite) or sandstone (quartz with clay and carbonate minerals). The inhibitor concertation in water is gradually decreased, which leads to the water becoming under- and un-protected by inhibitors, enabling scale to start to form. The formation rock can be plugged with scale deposition and injectivity is reduced. The traditional approach of minimizing scaling is often combined with stimulation treatment (either matrix acidizing or fracturing) that can be needed to restore the well injectivity.

Addressing the challenges of scaling control complexity, the implementations described in the present disclosure enable optimized scaling control using adjustable $CO_2$ injection based on thermodynamic models. An advantage of the implementations described in the present disclosure is that the thermodynamic models integrate measured thermodynamic data for determining an optimal amount of $CO_2$ injection relative to well characteristics, rather than injecting $CO_2$ separate from subterranean data, which can lead to scale control inefficiency. Configurations of the thermodynamic models can be adjusted to reflect well characteristics relative to most current well and hydrocarbon reservoir compliance requirements that are associated to highest safety standards. For example, using the described approaches, the determined amount of $CO_2$ injection and predicted scaling control efficiency are compared to safety limits to invoke safety protocols and to identify action plans to improve scale control efficiency and to protect well injectivity. Another advantage of the described technology is that it provides key recommended actions for scaling control to ensure optimization of oilfield produced water disposal. Furthermore, the described approach reduces the frequency or even eliminates the application of injection well stimulation treatments that can have detrimental environmental effects. Other advantages of the monitoring of thermodynamic parameters and scaling control operations techniques are described with reference to FIGS. 1A-1B, 2A-2D, and 3-5.

FIG. 1A is a block diagram illustrating an example system 100 for scaling control. Specifically, the illustrated example system 100 includes or is communicably coupled with a server system 102, a computing device 104, a data collection system 106, a network 108, a field management system 110, and an output reporting system 112. Although shown separately, in some implementations, functionality of two or more systems or components of the example system 100 can be provided by a single system or server. In some implementations, the functionality of one illustrated system, server, or component can be provided by multiple systems, servers, or components, respectively.

In the example of FIG. 1A, the server system 102 is intended to represent various forms of servers including, but not limited to a web server, an application server, a proxy server, a network server, and/or a server pool. In general, the server system 102 manages monitoring of thermodynamic parameters and scaling control operations within gas fields for management of well operations using any number of components of the example system 100 including computing devices 104 (e.g., over the network 108). In accordance with implementations of the present disclosure, and as noted above, the server system 102 can host a solution environment that can be a cloud environment providing software applications, systems, and services that can be consumed by customers as a service. In some instances, the server system 102 can support configuring of various tenants of different types, as well as services of different types that are integrated in customer integration scenarios and support execution of defined processes.

The server system 102 includes a memory 114A, an interface 116A, a processor 118A, a $CO_2$ injection controller 120, and a thermodynamic model 121. The memory 114A can store data (e.g., inputs and outputs of the $CO_2$ injection controller 120 and the thermodynamic model 121), such as probe data 122A, field data 122B, and action plans 122C. The probe data 122A can be received from the data collection system 106. The probe data 122A can include live monitoring data, such as pH data, temperature, flow rate, and pressure data. The field data 122B can include well and reservoir characteristics, which can be analyzed, by the thermodynamic model 121. In some implementations, an alert generation defined by the action plans 122C can also point to an internal security regulation set within the example system 100 (e.g., regulations adjusted to reflect the vulnerabilities of the field management system 110). The action plans 122C in the memory 114A can include action plan documents defining scaling prevention mechanisms including operations that can be performed by the components the example system 100 to optimize $CO_2$ injection operations. The thermodynamic model 121 can process data, obtained from the memory 114A, to analyze wells and hydrocarbon reservoirs within a field and to monitor thermodynamic parameters in real time for generating output signals for the $CO_2$ injection controller 120 enabling operation of the field management system 110 according to the action plans 122C.

The computing device 104, the field management system 110, and the output reporting system 112 can each be any computing device operable to connect to or communicate in the network(s) 108 using a wireline or wireless connection. In general, each of the computing device 104, the field management system 110, and the output reporting system 112 includes an electronic computer device operable to receive, transmit, process, and store any appropriate data associated with the example system 100 of FIG. 1A. Each of the computing device 104, the field management system 110, and the output reporting system 112 is generally intended to encompass any client computing device such as a laptop/notebook computer, wireless data port, smart phone, personal data assistant (PDA), tablet computing device, one or more processors within these devices, or any other suitable processing device. The computing device 104, the field management system 110, and the output reporting system 112, respectively include interface(s) 116B, 116C, 116D, processor(s) 118B, 118C, 118D, and memories 114B, 114C, 114D.

The computing device 104 and the output reporting system 112, respectively include graphical user interface(s) (GUIs) 126A and 126B. For example, the GUIs 126A, 126B include an input device, such as a keypad, touch screen, or other device that can accept user information, and an output device that conveys information associated with the operation of the server system 102, or the client device itself, including thermodynamic data (reports), $CO_2$ injection, and/or well operations, respectively. The GUIs 126A, 126B each interface with at least a portion of the example system 100 for any suitable purpose, including generating a visual representation of the data collected by the data collection system 106, data generated by the server system 102, or data stored by the server system 102, such as probe data 122A, field data 122B, and action plans 122C, respectively. In particular, the GUIs 126A, 126B can each be used to view and adjust various scaling control operations. Generally, the GUIs 126A, 126B each provide the user with an efficient and user-friendly presentation of thermodynamic data real time monitoring provided by or communicated within the example system 100. The GUIs 126A, 126B can each include multiple customizable frames or views having interactive fields, pull-down lists, and buttons operated by the user. The GUIs 126A, 126B can each be any suitable graphical user interface, such as a combination of a generic web browser, intelligent engine, and command line interface (CLI) that processes information and efficiently presents the results to the user visually.

The output reporting system 112 can include a reporting engine 124, the GUI 126B (dashboard), a user module, and administrator modules. The reporting engine 124 utilizes the analytics data provided by the thermodynamic model 121 to produce alerts to be displayed by the GUI 126B. The GUI 126B displays information related to scaling control monitoring, as described with reference to FIGS. 2A-2D and FIG. 3. The GUI 126B display can enable well management by supporting modification of $CO_2$ injection and well operations.

The data collection system 106 can include a safety control system 128 and multiple probes 130. The safety control system 128 controls operation of the probes 130 and directs collected data to the server system 102 for storage, further analysis, and correlations. The probes 130 can collect surface data and subterranean data within or near a well and an associated hydrocarbon reservoir. The probes 130 can be coupled to or integrated in different types of components of the wells, to continuously monitor thermodynamic parameters and scaling control operations (e.g., $CO_2$ injection). Further details about the probes 130 and their operation are provided with reference to FIG. 1B.

In some implementations, the network 108 can include a large computer network, such as a local area network, a wide area network, the Internet, a cellular network, a telephone network, or an appropriate combination thereof connecting any number of communication devices, mobile computing devices, fixed computing devices and server systems. Data exchanged over the network 108, is transferred using any number of network layer protocols, such as internet protocol, multiprotocol label switching, asynchronous transfer mode, Frame Relay, etc. Furthermore, in implementations where the network 108 represents a combination of multiple sub-networks, different network layer protocols are used at each of the underlying sub-networks. In some implementations, the network 108 represents one or more interconnected internetworks, such as the public Internet.

Each processor 118A, 118B, 118C, 118D, 118E included in different components of the example system 100 can include a central processing unit (CPU), an application specific integrated circuit (ASIC), a field-programmable gate array (FPGA), or another suitable component. Generally, each processor 118A, 118B, 118C, 118D, 118E executes instructions and manipulates data to perform monitoring of thermodynamic parameters and scaling control operations. For example, each processor 118A, 118B, 118C, 118D, 118E executes a functionality required to monitor thermodynamic parameters, to plan $CO_2$ injections, and determine efficiency of scaling control operations.

Interfaces 116A, 116B, 116C, 116D, 116E are used by different components of the example system 100 for communicating with other component systems in a distributed environment—including within the example system 100—connected to the network 108. Generally, the interfaces 116A, 116B, 116C, 116D, 116E each include logic encoded in software and/or hardware in a suitable combination and operable to communicate with the network 108. More specifically, the interfaces 116A, 116B, 116C, 116D, 116E can each include software supporting one or more communication protocols associated with communications such that the network 108 or interface's hardware is operable to communicate physical signals within and outside of the illustrated system 100.

The memory 1114A, 114B, 114C, 114D can include any type of memory or database module and can take the form of volatile and/or non-volatile memory including, without limitation, magnetic media, optical media, random access memory (RAM), read-only memory (ROM), removable media, or any other suitable local or remote memory component. The memory 1114A, 114B, 114C, 114D can store various objects or data, including caches, classes, frameworks, applications, backup data, business objects, jobs, web pages, web page templates, database tables, database queries, repositories storing safety data and/or dynamic information, and any other appropriate information including any parameters, variables, algorithms, instructions, rules, constraints, or references thereto associated with the purposes of the server system 102, the computing device 104, the data collection system 106, the field management system 110, and the output reporting system 112, respectively.

There can be any number of computing devices 104 and data collection systems 106 associated with, or external to, the example system 100. Additionally, there can also be one or more additional client devices external to the illustrated portion of system 100 that can interact with the example system 100 via the network(s) 108. Further, the term "client," "client device," and "user" can be used interchangeably as appropriate without departing from the scope of the disclosure. Moreover, while client device can be described in terms of being used by a single user, the disclosure contemplates that many users can use one computer, or that one user can use multiple computers. As used in the present disclosure, the term "computer" is intended to encompass any suitable processing device. For example, although FIG. 1A illustrates a single server system 102, a single computing device 104, a single data collection system 106, a single field management system 110, the example system 100 can be implemented using a single, stand-alone computing device, two or more server systems 102, or multiple client devices. The server system 102, the computing device 104 and the output reporting system 112 can include any computer or processing device. According to one implementation, the server system 102 can also include or be communicably coupled with an e-mail server, a Web server, a caching server, a streaming data server, and/or another suitable server, as described with reference to FIG. 1B.

Figure 1B:
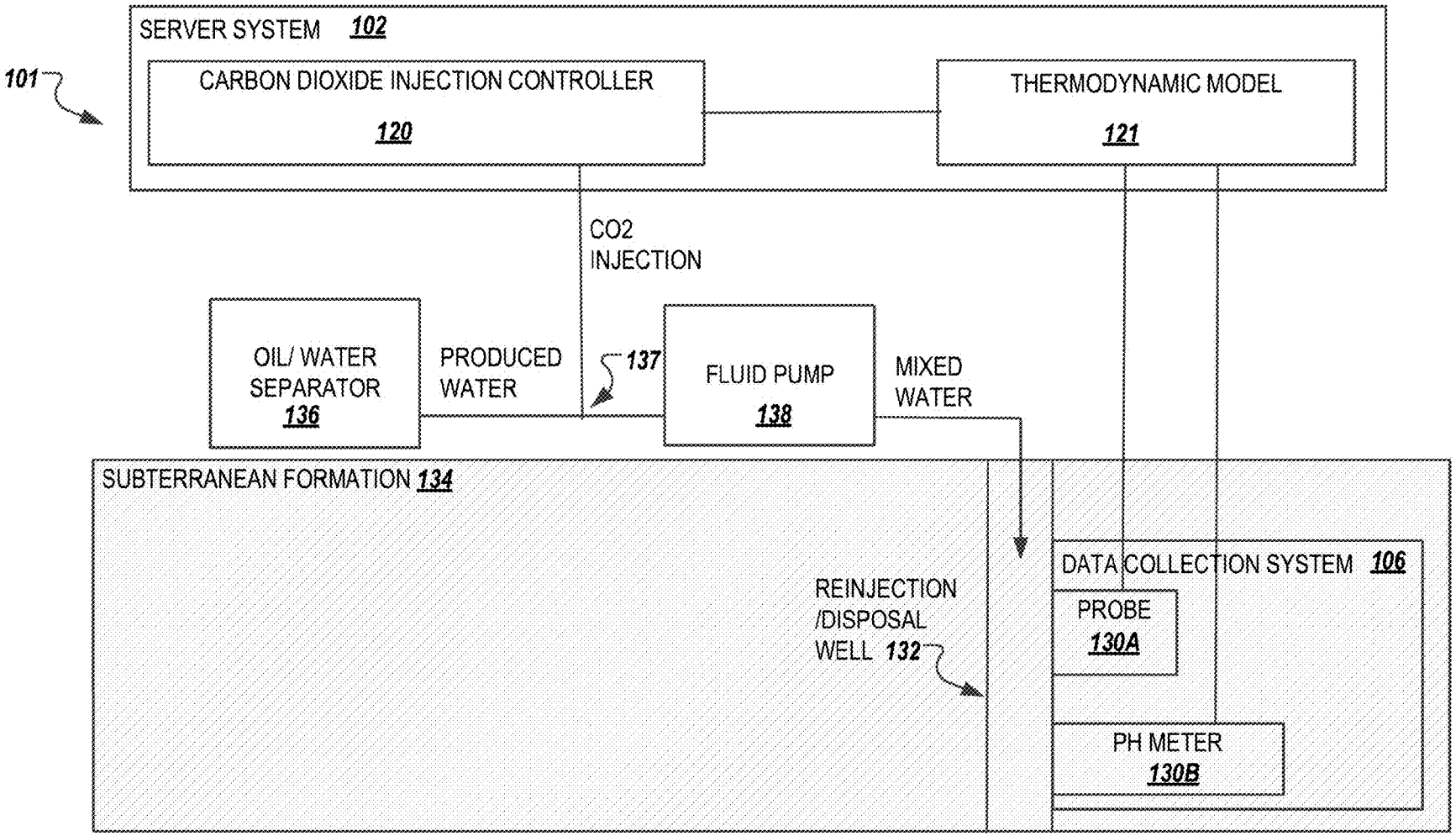
FIG. 1B is a block diagram of a portion of the example system that can be used to execute implementations of the present disclosure.

To further illustrate, FIG. 1B depicts a schematic diagram illustrating an example portion 101 of the example system 100 described with reference to FIG. 1A, in accordance with some example implementations. The example portion 101 of the example system 100 illustrated in FIG. 1B includes the server system 102, the data collection system 106, a reinjection/disposal well 132, an oil-water separator 136, and a fluid pump 138. The server system 102 includes the $CO_2$ injection controller 120 and the thermodynamic model 121. The thermodynamic model 121 processes thermodynamic data collected by the probes 130A, PH meter 130B within a reinjection/disposal well 132 and a subterranean formation 134.

The probes 130A can be used to measure thermodynamic data including well data and subterranean formation data. The thermodynamic data can include temperature, pressure data, and flow data measured by probes 130A distributed along the well 132. The probes 130A can be static or mobile sensors recording data at a fixed location or multiple locations within the subterranean formation 134. The probes 130A can record data according to a set frequency and/or a schedule and can transmit the collected data in real time (within less than a second after data collection) to the server system 102 to be processed by the thermodynamic model 121. The probes 130A can be wired or wirelessly connected to the network 108 to transmit the collected data to the server system 102.

The pH meter 130B can be located within the reinjection/disposal well 132 to monitoring the acidity or alkalinity of the water being injected. For example, the pH meter 130B can be installed at a downstream mixing point of the injected $CO_2$ and PW streams to monitor the pH after fully mixing. The location of the pH meter 130B can be greater than 60 meters away from the mixing point (intersection point 137 of $CO_2$ pipe and water pipe) to make sure that the liquified or supercritical $CO_2$ is fully mixed with the water stream. In some implementations, the mixing point (intersection point 137 of $CO_2$ pipe and water pipe) can be within or proximal (ahead) of the fluid pump 138. The pH meter 130B can include a sensor that measures the hydrogen ion activity in the water. The pH meter 130B can include a glass electrode and a reference electrode facilitating the measurement of the hydrogen ion activity in the water by measuring the voltage difference between the glass electrode and the reference electrode. The pH meter 130B can include a temperature sensor to compensate for temperature variations, ensuring accurate readings. The pH meter 130B can log data over time, for continuous monitoring of pH in the reinjection/disposal well 132.

In some examples, preexisting well information can be used for optimizing scaling control. For example, well geometry, structure, and configuration can be combined with thermodynamic data and pH data, by the thermodynamic model to optimize the calculation of the $CO_2$ amount to be injected. Additionally, reservoir properties determined in the production phase can be used for optimizing scaling control. By using the actual properties of the reservoir, the thermodynamic model 121 can include the reservoir composition and geometry for the optimization calculations.

The thermodynamic model 121 can process data collected by the probes 130A and the pH meter 130B to determine an initial and an updated amount of $CO_2$ to be injected. The thermodynamic model 121 can transmit the amount of $CO_2$ to be injected to the $CO_2$ injection controller 120 to control $CO_2$ injection to inject $CO_2$ into the water produced by the oil-water separator 136. The oil-water separator 136 includes an inlet, a separation chamber, an oil collection chamber, a sludge collection chamber, and an outlet. The separation chamber facilitates the filtration of the fluid received through the inlet to remove oil and sediments from water. The separation chamber can include baffles or coalescing plates to enhance separation efficiency. The removed oil can be collected in the oil collection chamber and the sediments can be collected in the sludge collection chamber. The filtered water that is produced by the by the oil-water separator 136 can include multiple dissolved salts. An example of salt compositions in water at different oilfields is shown in Table 1.

TABLE 1

Compositions of selected produced waters from different oilfields

| Parameter (unit) | #1 | #2 | #3 | #4 | #5 | #6 | #7 | #8 | #9 |
|---|---|---|---|---|---|---|---|---|---|
| Na (mg/L) | 2,300 | 7,943 | 18,616 | 12,960 | 16,517 | 20,433 | 26,550 | 34,513 | 56,500 |
| K (mg/L) | 78 | 174 | 781 | 554 | 716 | 750 | 884 | 1,706 | 2,977 |
| Mg (mg/L) | 94 | 581 | 1392 | 1,201 | 1,288 | 1,428 | 495 | 3,157 | 2,277 |
| Ca (mg/L) | 757 | 1,485 | 2,835 | 3,535 | 2,817 | 3,194 | 3,232 | 19,852 | 14,449 |
| St (mg/L) | 18 | 131 | 804 | 75 | 181 | 70 | 342 | 1,354 | 804 |
| Alkalinity (mg/L) | 323 | 523 | 1,010 | 235 | 694 | 679 | 182 | 268 | 138 |
| Cl (mg/L) | 4,100 | 16,103 | 37555 | 29,490 | 34,211 | 40,889 | 48,300 | 99,900 | 122,000 |
| $SO_4$ (mg/L) | 1,270 | 321 | 1,323 | 662 | 656 | 1,184 | 1,300 | 284 | 420 |
| TDS (mg/L) | 8,950 | 27,344 | 64,315 | 48,730 | 57,146 | 68,626 | 81,300 | 161,100 | 199,800 |
| pH (pH unit) | 6.9 | 6.8 | 7.6 | 7.1 | 6.9 | 7.2 | 7.0 | 6.1 | 5.9 |

The water compositions in Table 1 are a mixture of original reservoir connate waters and the injection waters mixed in the reservoirs. The example water compositions cover a wide range of water geochemistry, with total dissolved salts (TDS) from <9,000 mg/L up to 200,000 mg/L, divalent cation calcium from 757 mg/L to 19,852 mg/L and alkalinity from 138 mg/L to 1,010 mg/L. Although wide variations on dissolved ion concentrations, all produced waters listed in Table 1 are prone to form calcium carbonate scale. Table 2 summarizes the calculated $CaCO_3$ supersaturation degrees (SSD) for waters listed in Table 1 under an example typical surface conditions (51° C., 250 psi) and subsurface conditions (90° C., 3500 psi) conditions for produced water disposal or reinjection in a temperate or subtropical example region.

TABLE 2

$CaCO_3$ supersaturation degrees (SSD) of produced waters (Table 1) under surface and subsurface conditions

| | #1 | #2 | #3 | #4 | #5 | #6 | #7 | #8 | #9 |
|---|---|---|---|---|---|---|---|---|---|
| 125° F., 250 psi | 3.0 | 6.8 | 96.6 | 12.6 | 20.9 | 45.7 | 8.0 | 7.7 | 2.6 |
| 200° F., 3500 psi | 7.0 | 14.1 | 150.1 | 20.9 | 37.0 | 71.4 | 13.1 | 5.5 | 2.1 |

The filtered water that is produced is ejected, by the oil-water separator 136, through the outlet into a pipe leading towards the fluid pump 138. The fluid pump 138 can facilitate mixture of the injected $CO_2$ and the water and direct the mixed fluid into a pipe directing the mixed fluid towards the reinjection/disposal well 132.

The thermodynamic model 121 can process data collected by the probes 130A and the pH meter 130B after the mixed fluid is directed towards the reinjection/disposal well 132, to evaluate injection efficiency in preventing scaling at one or more locations within the well 132. In some implementations, the thermodynamic model 121 includes a machine learning model that is based on machine learning techniques related to a deep neural network (DNN). A deep neural network can be referred to as a network because it can be represented by connecting different functions. For example, a model of the DNN can be represented as a graph representing how the functions are connected from an input layer, through one or more hidden layers, and finally to an output layer, and each layer can have one or more nodes. In an example, the DNN of the subject technology generates dynamically adjusted $CO_2$ injection estimates. The DNN model can represent the relationship between the $CO_2$ injection, thermodynamic data collected by the probes 130A, pH values collected by the pH meter 130B and the risk of scaling formation.

In one or more implementations, relationships the $CO_2$ injection, thermodynamic data collected by the probes 130A, pH values collected by the pH meter 130B, and the risk of scaling formation can be determined during training of the DNN. The training step optimizes the weights and biases in the hidden and output layer such that the estimation error between the estimated thermodynamic data with pH values and observed thermodynamic data with pH values from the probes 130A and PH meter 130B can be minimized. Estimation error can be root mean square deviation, or a composite of root mean square deviation, cross-correlation, or a geoscience error metric. To avoid overfitting during training, regularization of the estimation error is performed based upon the norms of weights in the hidden layers that are added to the estimation error. An optimization process can include application of a stochastic gradient descent algorithm (or any other appropriate optimization algorithm), which can use one or more iterative optimization techniques and/or use a small subset of the training dataset or batch with training samples randomly selected at a time. The variances calculated based upon the horizontal and vertical semi-variograms are included in the input feature. The optimization process can optimize the weights and biases associated with the vertical and horizontal semi-variances, and other input features such that an error in the property estimates relative to the observed property values can be minimized. The process of training described here not only can minimize the error in scaling risk estimates, but also can incorporate $CO_2$ injection amount variance relative to the geomechanical properties of the well 132 and the subterranean formation 134. Following the completion of training that can be determined by the estimation error on the validation dataset falling below a cut-off value, the testing dataset can be used to determine the performance of the trained DNN on unseen well logs (e.g., not used for training). The trained DNN provides the ability of predicting the $CO_2$ injection amount for scaling control based on the measured thermodynamic data and recorded pH values.

Although a DNN was discussed for the purposes of explanation, it is appreciated that the thermodynamic model 121 can include other trainable machine learning techniques. Further, it is appreciated that other types of neural networks can be utilized by the subject technology. For example, a convolutional neural network, regulatory feedback network, radial basis function network, recurrent neural network, modular neural network, instantaneously trained neural network, spiking neural network, regulatory feedback network, dynamic neural network, neuro-fuzzy network, compositional pattern-producing network, memory network, and/or any other appropriate type of neural network can be utilized.

Figure 2A:
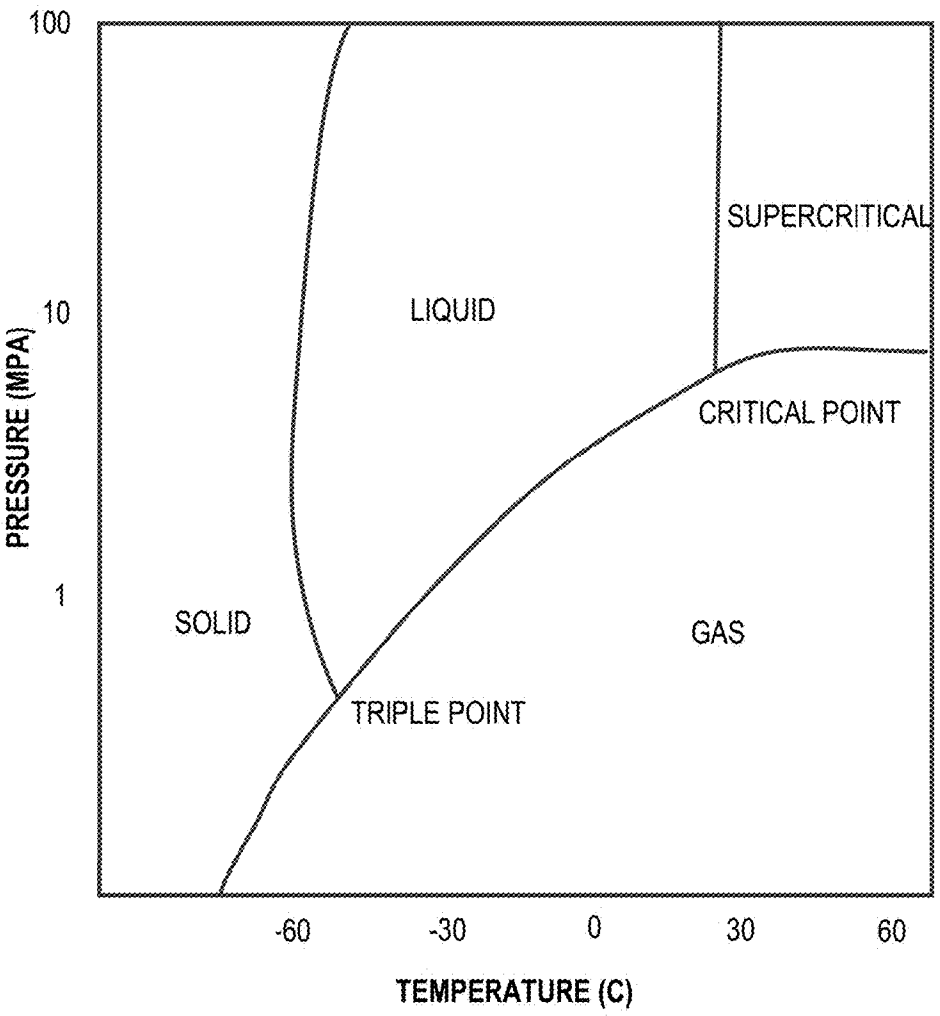
FIG. 2A illustrates an example carbon dioxide phase transition diagram, in accordance with some example implementations.

FIG. 2A illustrates an example $CO_2$ phase transition diagram 200A, in accordance with some example implementations. The example $CO_2$ phase transition diagram 200A illustrates a function of the $CO_2$ state relative to temperature and pressure. The $CO_2$ injection controller (e.g., the $CO_2$ injection controller 120 described with reference to FIGS. 1A and 1B) can be configured to control the injection of $CO_2$ in a particular state (e.g., gas, liquid, solid, or super-critical) by adjusting pressure and temperature. For example, the $CO_2$ can be injected into the produced water stream as a supercritical fluid, or as pure $CO_2$ gas, or as $CO_2$-rich liquid or even solid. The supercritical phase of $CO_2$ occurs when it is held at or above its critical temperature (31.0° C. or 87.8° F.) and critical pressure (7.38 MPa or 1,070 psi). In the supercritical state, $CO_2$ exhibits properties of both a gas and a liquid, expanding to fill a container like a gas but having a density similar to a liquid. For industrial applications, liquified $CO_2$ is normally applied. It can be injected into the water stream and mixed as two fluids. The turbulent flow conditions can naturally mix the liquified $CO_2$ and water streams. A benefit of using supercritical $CO_2$ instead of just $CO_2$ gas is that liquified $CO_2$ or supercritical $CO_2$ are easier to transport, easier to mix with the water stream, have a have a high density, and are easier to store than $CO_2$ in gas state.

Figure 2B:
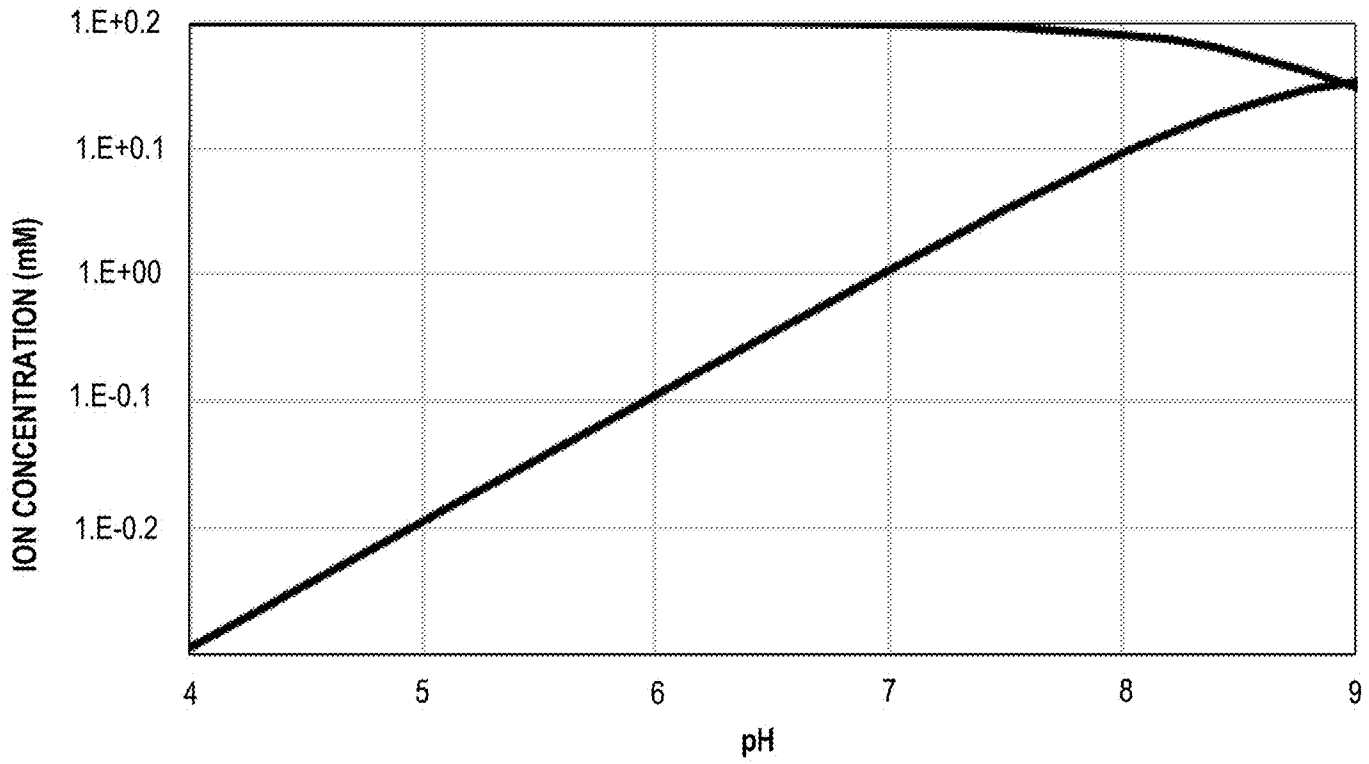
FIG. 2B illustrates an example diagram of changes of carbonate and bicarbonate concentrations with acidity (pH), in accordance with some example implementations.

FIG. 2B illustrates an example diagram 200B of changes of carbonate and bicarbonate concentrations with acidity (pH), in accordance with some example implementations. The example diagram 200B shows the change of carbonate and bicarbonate concentrations with pH at the constant alkalinity of 100 mM (=6,100 mg/L as $HCO_3^-$). The changes of produced water pH and supersaturation stage to $CaCO_3$ with $CO_2$ addition can be calculated using thermodynamic models (e.g., thermodynamic model 121 described with reference to FIGS. 1A and 1B) based on $CO_2$ equilibrium and using Pitzer equation of ion activity. The Pitzer equation is used to characterize high ionic strength solutions, where it provides an accurate representation of ion interactions compared to simpler models like the Debye-Hückel theory. The Pitzer equation is included in the thermodynamic models for calculating activity coefficients, which indicate the behavior of ions in solutions. By incorporating the Pitzer equation into the thermodynamic model, the effect of the addition of a particular amount of $CO_2$ on the pH and the degree of supersaturation of $CaCO_3$ can be estimated. The estimation involves calculating the equilibrium concentrations of various ionic compositions in the solution and their activities, which can influence the pH and the precipitation or dissolution of $CaCO_3$.

Figure 2C:
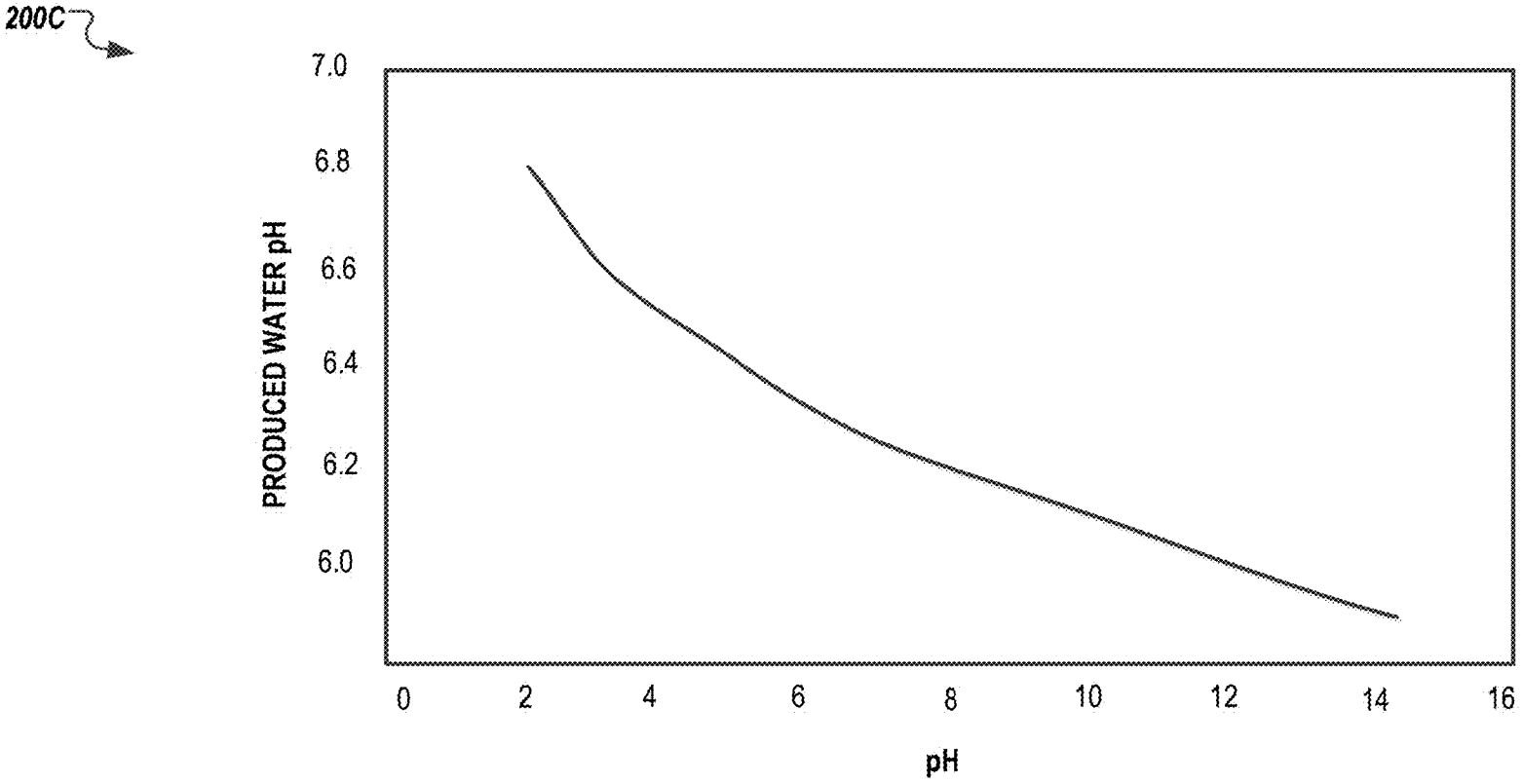
FIG. 2C illustrates an example diagram of pH with carbon dioxide addition for water, in accordance with some example implementations.
Figure 2D:
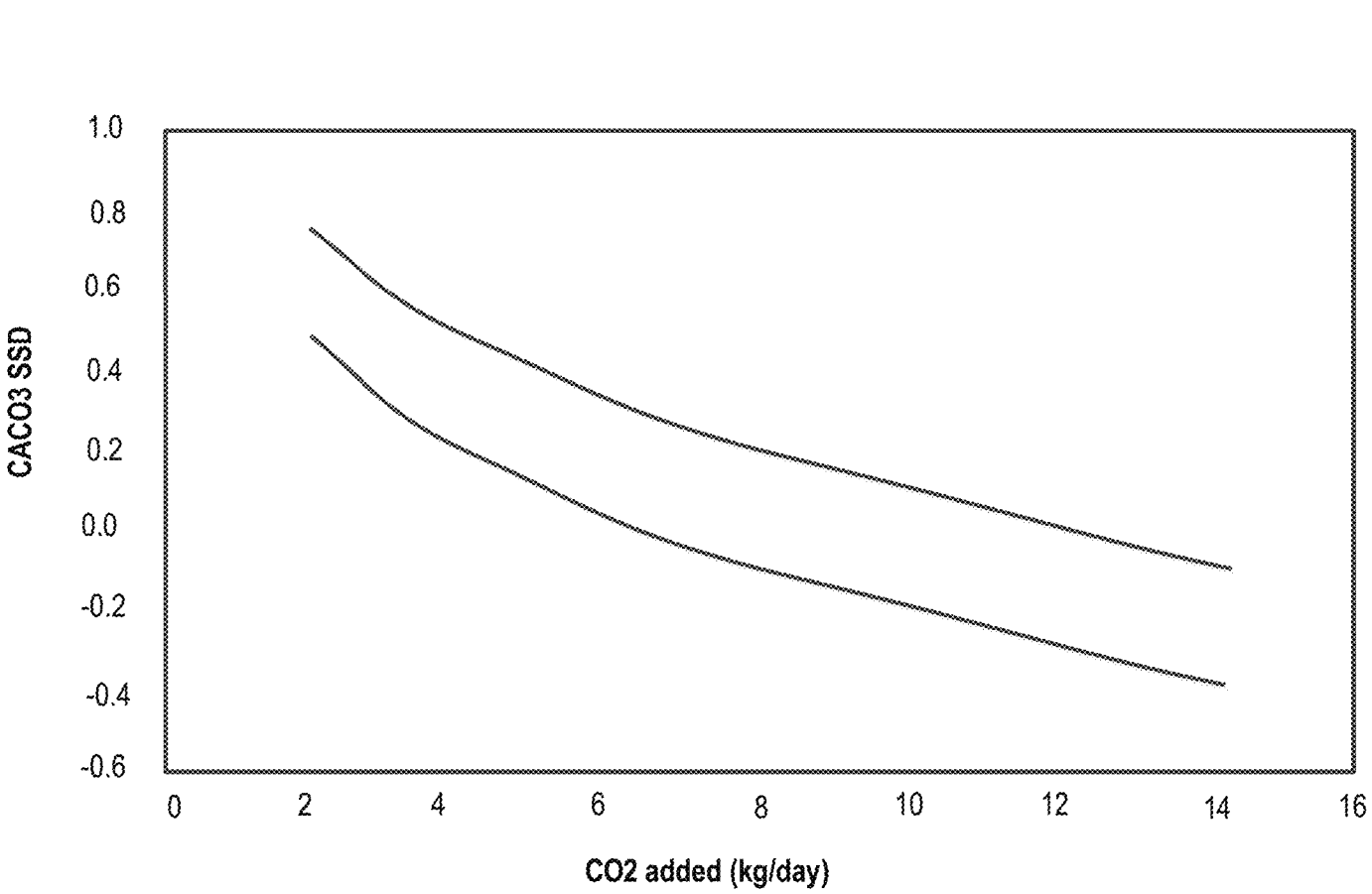
FIG. 2D illustrates an example diagram of changes of calcium carbonate saturation of water with carbon dioxide addition, in accordance with some example implementations.

FIG. 2C illustrates an example diagram 200C of pH with carbon dioxide addition for water, in accordance with some example implementations. FIG. 2D illustrates an example diagram 200D of changes of calcium carbonate saturation of water with carbon dioxide addition, in accordance with some example implementations. The example diagrams 200C and 200D can be used to identify an optimal amount of $CO_2$ to be added to water to minimize scaling risk. For example, FIGS. 2C and 2D show that with 12.2 kg of $CO_2$ added to the water stream per day, the water having the composition of the first column in Table 1, which has a flow rate of 10,000 barrels per day reach an equilibrium state with $CaCO_3$ scale (SSD=0) under the subsurface conditions (90° C., 3500 psi). A thermodynamic model processing the example diagrams 200C and 200D can determine that 12.2 kg $CO_2$ or more added per day to the example water stream can neutralize the risk to $CaCO_3$ formation in the injected reservoir (SSD≤0), such that the scaling risk is completely mitigated.

The example diagrams 200B, 200C, 200D can be displayed by graphical user interfaces that can be any of the GUIS 126A, 126B, described with reference to FIGS. 1A and 1B. The example diagrams 200B, 200C, 200D, shown in FIGS. 2B-2D, can be used to monitor scaling control efficiency in real time. The example diagrams 200B, 200C, 200D can include data obtained from a database (e.g., memory 114A, described with reference to FIG. 1A) and data (e.g., wellhead and downhole parameters) collected by the probes 130A, described with reference to FIGS. 1A and 1B. The example diagrams 200C and 200D can represent measured thermodynamic data as a function of $CO_2$ injection that can be adjusted to optimize scaling control. A key feature of the user interfaces displaying the example diagrams 200B, 200C, 200D is the ability to set alerts and notifications for particular thresholds (e.g., pH or supersaturation degree thresholds) or changes of particular thermodynamic data ensuring the sustainability, integrity and safety of the scaling control operations.

Figure 3:
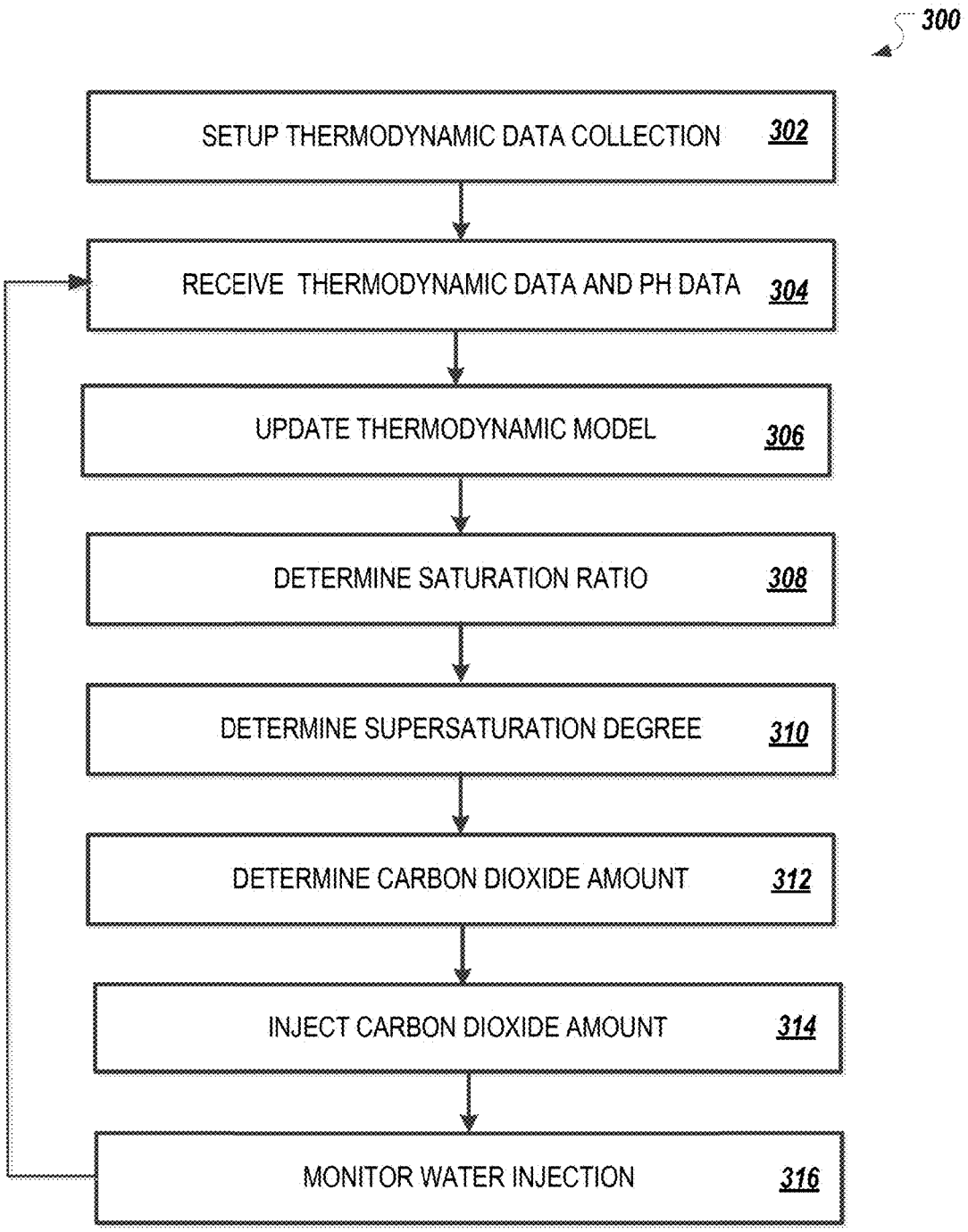
FIG. 3 depicts a flowchart illustrating an example process for monitoring of thermodynamic parameters and scaling control operations, in accordance with some example implementations.

FIG. 3 depicts a flowchart illustrating an example process 300 for monitoring of thermodynamic parameters and scaling control operations, in accordance with some example implementations. Referring to FIGS. 1A and 1B, the process 300 can be performed by any components of the example system 100. The example process 300 can be executed using, e.g., any component of the example system 100 described with reference to FIG. 1A or example system 101 described with reference to FIG. 1B. Operations of the process 300 are described below for illustration purposes only. Operations of the process 300 can be performed by any appropriate device or system, e.g., any appropriate data processing apparatus. Operations of the process 300 can also be implemented as instructions stored on a computer readable medium, which can be non-transitory. Execution of the instructions causes one or more data processing apparatus to perform operations of the process 300.

At 302, collection of data using multiple probes is configured, by one or more processors configured to manage thermodynamic data collection. The management of probe data collection can include setting up a frequency and/or a schedule of collecting data from the probes as described with reference to FIGS. 1A and 1B. Each of the probes can be configured to activate data collection and/or transmission according to a respective schedule defining a frequency of data collection and a duration of each collection duration. The probes can be configured to collect data continuously (according to the respective schedule) or can have a set trigger that initiates data collection in response to detection of one or more conditions for data collection. The conditions can be defined based on safety regulations and reinjection or disposal well operational conditions regarding an operational status (e.g., fully operational, partly operational, or minimally operational) of the reinjection or disposal well (e.g., reinjection or disposal well 132 described with reference to FIG. 1B). In some implementations, a list of safety standards and controls are processed to initiate a real time thermodynamic condition assessment identifying coupled probes to be activated for collecting thermodynamic data. The thermodynamic data can be collected by probes included in the reinjection or disposal well or within a field, proximal to the reinjection or disposal well. The thermodynamic data can include surface data collected by probes located on or near a wellhead and subterranean data located within or near a downhole, the thermodynamic data being indicative of thermodynamic conditions that can affect a scaling risk. For example, the thermodynamic data can include fluid injection rate, injected volume, pressure measurements at different locations, temperatures at multiple locations, fluid composition, flow rate, and any other measurable variable parameter indicative of scaling risk. The probes can include a pH meter facilitating measurement of fluid acidity (pH data). The pH meter can be located at least about 60 meters after (downstream of) a mixture point (e.g., a fluid pump). The location of the pH meter 130B can be at a distance where $CO_2$ is estimated to be fully mixed with the water stream. The distance can be greater than 60 meters away from the mixing point (intersection point of $CO_2$ pipe and water pipe). In some implementations, the mixing point can be within or proximal (ahead) of a fluid pump that facilitates regulation of the produced water stream flow rate within the well.

At 304, the thermodynamic data and the fluid acidity are received, by the one or more processors of a server system configured to process the received data. The received thermodynamic data can be prefiltered by the probes that generated the probe data. For example, for conserving system resources by minimizing network traffic, a portion of the probes can be configured to transmit filtered (e.g., averaged) data (excluding anomalous data or outlier data). The anomalous data can be identified as data outliers and/or data having one or more characteristics (frequency and/or amplitude) outside of an expected range. For example, the probes can include a high pass filter or a low pass filter to separate the anomalous data from normal operational data and remove the anomalous data.

At 306, the thermodynamic model is updated to provide a robust well and reservoir representation. In some implementations, the thermodynamic model is tailored to include a measured produces water composition and one or more characteristics (geometry, structure, and composition) of the well and reservoir. The produced water stream can include multiple ion components, such as sodium ($Na^+$), chloride ($Cl^-$), calcium ($Ca^{2+}$), magnesium ($Mg^{2+}$), bicarbonate ($HCO^{3-}$), and sulfate ($SO_4^{2-}$), as described with reference to Table 1. The thermodynamic model defines a $CO_2$ equilibrium using Pitzer equation of ion activity. The Pitzer equation characterizes high ionic strength solutions indicative of a scaling risk. The thermodynamic model provides an accurate representation of ion interactions derived from measured ionic compositions.

At 308, a saturation ratio (SR) is determined based on a composition of the produced water stream. The SR is the ratio of scaling ion activity products and scale mineral solubility. For the scaling risk of interest ($CaCO_3$), $$SR=(Ca^{2+}\times CO_3)/K_{SP}(CaCO_3)$$

The solubility product constant of calcium carbonate ($K_{SP}(CaCO_3)$) represents the solubility of calcium carbonate expressed as $=[Ca^{2+}][CO_3^{2-}]\approx[CaCO_3]^2$ where $[CaCO_3]$ is the concentration of the undissociated $CaCO_3$ in the solution.

At 310, a supersaturation degree is determined based on the calculated SR. supersaturation degree (SSD) is defined as saturation ratio (SR) minus 1:

$$SSD=SR-1$$

A determined value of SSD greater than a unit value (1) indicates that the water is supersaturated and unstable, $CaCO_3$ scale can form if not interfered with. The higher the SSD value, the further the produced water is from an equilibrium state and higher is a risk of the $CaCO_3$ scaling to form.

At 312, an amount of $CO_2$ to be injected in the produced water stream to neutralize a scaling risk is determined using the thermodynamic model and the supersaturation degree. For example, by incorporating the Pitzer equation into the thermodynamic model, the effect of the addition of a particular amount of $CO_2$ on the pH and the degree of supersaturation of $CaCO_3$ can be estimated. The estimation involves calculating the equilibrium concentrations of various ionic compositions in the solution and their respective association and dissociation activities, which can influence the pH and the scaling risk expressed relative to the precipitation or dissolution of $CaCO_3$. The amount of $CO_2$ to be injected in the produced water stream to neutralize a scaling risk is a critical amount of $CO_2$ to reach the $CaCO_3$ equilibrium at any given condition (produced water flow rate, reservoir temperature and pressure). The critical amount of $CO_2$ to reach the $CaCO_3$ equilibrium at any given condition is determined using the produced water pH and $CaCO_3$ saturation state.

At 314, the determined amount of $CO_2$ is injected, by a carbon dioxide injection controller, in the produced water stream to neutralize the scaling risk. For example, the carbon dioxide injection controller can be activated to inject $CO_2$ in a particular state (liquid or supercritical) by controlling the pressure and temperature of the injected $CO_2$, as discussed with reference to FIG. 2A. The carbon dioxide injection controller can receive the $CO_2$ from one or more sources. The sources of $CO_2$ can be, but are not limited to, oil and gas exploration, power generation, transportation, industrial sources, chemical production, petroleum production, and agricultural practices. Many of these source types burn fossil fuels (coal, oil, and natural gas), with $CO_2$ emissions as a byproduct.

At 316, the water injection process is monitored for safety and verification that scaling risk remains neutralized. A scaling control report can be provided as a full or as a partially customized assessment. For example, the graphical user interface provides customizable features used for configuring the assessment reporting results and recommendations to monitor the health of the gas storage reservoir and well operation safety.

The example process 300 allows remotely configuring probes for collection of thermodynamic data and acidity data including a broad spectrum of information by gathering probe data from different types of probes. The thermodynamic assessment can be scheduled and automated, being initiated with probe data collection. The example process 300 provides accurate and consistent assessment results, by applying quantifiable measures of scaling control and continuous verifications. The example process 300 is used to monitor real-time thermodynamic data of crucial thermodynamic parameters, such as gas flowrates, pressures, temperatures, and other thermodynamic parameters. The example process 300 enables automatic control of one or more devices (e.g., carbon dioxide injection controller and fluid pump) for automatically minimizing scaling risk. The data generated during the example process 300 is displayed on a user-friendly interface including various dashboards and reports, enabling a comprehensive scaling risk analysis.

Figure 4:
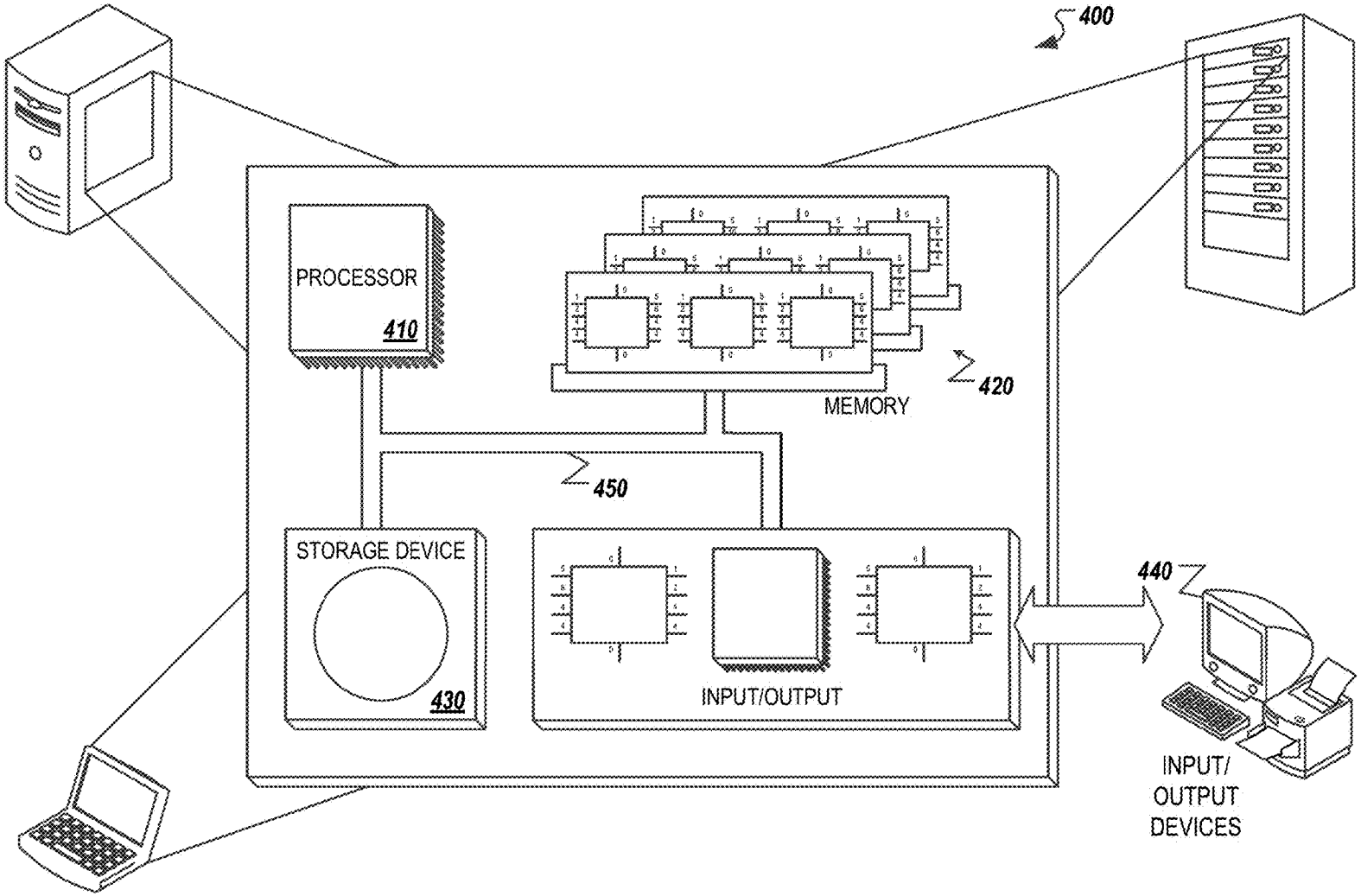
FIG. 4 depicts a block diagram illustrating a computing system, in accordance with some example implementations.

FIG. 4 depicts a block diagram illustrating a computing system 400, in accordance with some example implementations. Referring to FIGS. 1A and 1B, the computing system 400 can be used to implement the server system 102 and/or any other components of the example system 100.

As shown in FIG. 4, the computing system 400 can include a processor 410, a memory 420, a storage device 430, and input/output devices 440. The processor 410, the memory 420, the storage device 430, and the input/output devices 440 can be interconnected using a system bus 450. The processor 410 is capable of processing instructions for execution within the computing system 400. Such executed instructions can implement one or more components of, for example, the example system 100. In some implementations of the current subject matter, the processor 410 can be a single-threaded processor. Alternately, the processor 410 can be a multi-threaded processor. The processor 410 is capable of processing instructions stored in the memory 420 and/or on the storage device 430 to display graphical information for a user interface provided using the input/output device 440.

The memory 420 is a computer readable medium such as volatile or non-volatile that stores information within the computing system 400. The memory 420 can store data structures representing configuration object databases, for example. The storage device 430 can provide persistent storage for the computing system 400. The storage device 430 can be a floppy disk device, a hard disk device, an optical disk device, or a tape device, or other suitable persistent storage means. The input/output device 440 provides input/output operations for the computing system 400. In some implementations of the current subject matter, the input/output device 440 includes a keyboard and/or pointing device. In various implementations, the input/output device 440 includes a display unit for displaying graphical user interfaces.

According to some implementations of the current subject matter, the input/output device 440 can provide input/output operations for a network device. For example, the input/output device 440 can include Ethernet ports or other networking ports to communicate with one or more wired and/or wireless networks (e.g., a local area network (LAN), a wide area network (WAN), the Internet).

In some implementations of the current subject matter, the computing system 400 can be used to execute various interactive computer software applications that can be used for organization, analysis and/or storage of data in various (e.g., tabular) format (e.g., Microsoft Excel®, and/or any other type of software). Alternatively, the computing system 400 can be used to execute any type of software applications. These applications can be used to perform various functionalities, e.g., planning functionalities (e.g., generating, managing, editing of spreadsheet documents, word processing documents, and/or any other objects), computing functionalities, or communications functionalities. The applications can include various add-in functionalities or can be standalone computing products and/or functionalities. Upon activation within the applications, the functionalities can be used to generate the user interface provided using the input/output device 440. The user interface can be generated and presented to a user by the computing system 400 (e.g., on a computer screen monitor).

One or more aspects or features of the subject matter described herein can be realized in digital electronic circuitry, integrated circuitry, specially designed ASICs, field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system can include clients and servers. A client and server are generally remote from each other and typically interact through a communication network. The relationship of client and server arises by virtue of computer programs running on the respective computers and having a client-server relationship to each other.

These computer programs, which can also be referred to as programs, software, software applications, applications, components, or code, include machine instructions for a programmable processor, and can be implemented in a high-level procedural and/or object-oriented programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random-access memory associated with one or more physical processor cores.

To provide for interaction with a user, one or more aspects or features of the subject matter described herein can be implemented on a computer having a display device, such as for example a cathode ray tube (CRT) or a liquid crystal display (LCD) or a light emitting diode (LED) monitor for displaying information to the user and a keyboard and a pointing device, such as for example a mouse or a trackball, by which the user can provide input to the computer. Other kinds of devices can be used to provide for interaction with a user as well. For example, feedback provided to the user can be any form of sensory feedback, such as for example visual feedback, auditory feedback, or tactile feedback; and input from the user can be received in any form, including acoustic, speech, or tactile input. Other possible input devices include touch screens or other touch-sensitive devices such as single or multi-point resistive or capacitive track pads, voice recognition hardware and software, optical scanners, optical pointers, digital image capture devices and associated interpretation software, and the like.

Figure 5:
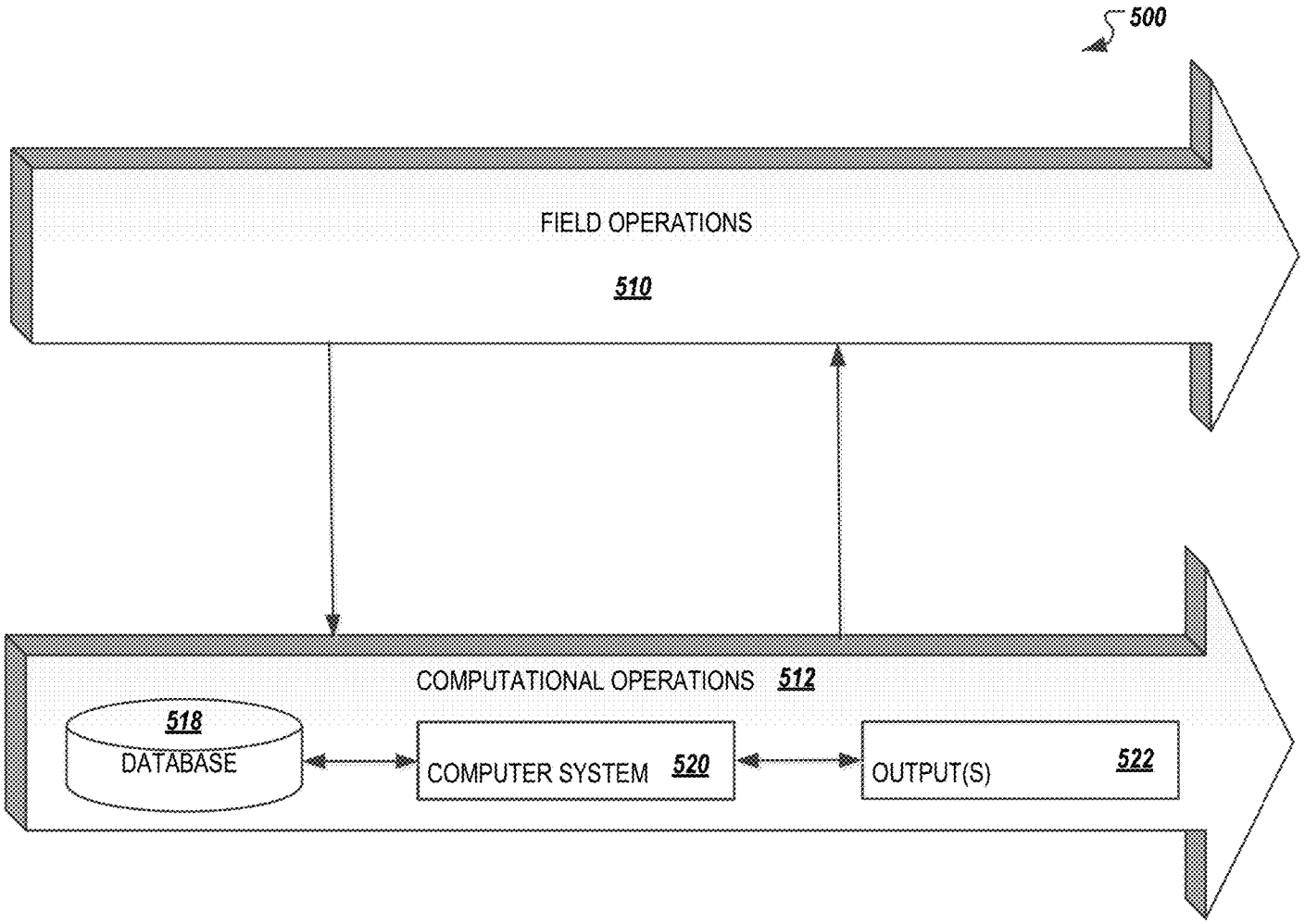
FIG. 5 illustrates hydrocarbon production operations, in accordance with some example implementations.

FIG. 5 illustrates hydrocarbon production operations 500 that include both one or more field operations 510 and one or more computational operations 512, which exchange information and control exploration to produce hydrocarbons. In some implementations, outputs of techniques of the present disclosure can be performed before, during, or in combination with the hydrocarbon production operations 500, specifically, for example, either as field operations 510 or computational operations 512, or both.

Examples of field operations 510 include forming/drilling a wellbore, hydraulic fracturing, producing through the wellbore, injecting fluids (such as water) through the wellbore, to name a few. In some implementations, methods of the present disclosure can trigger or control the field operations 510. For example, the methods of the present disclosure can generate data from hardware/software including sensors and physical data gathering equipment (e.g., seismic sensors, well logging tools, flow meters, and temperature and pressure sensors). The methods of the present disclosure can include transmitting the data from the hardware/software to the field operations 510 and responsively triggering the field operations 510 including, for example, generating plans and signals that provide feedback to and control physical components of the field operations 510. Alternatively, or in addition, the field operations 510 can trigger the methods of the present disclosure. For example, implementing physical components (including, for example, hardware, such as sensors) deployed in the field operations 510 can generate plans and signals that can be provided as input or feedback (or both) to the methods of the present disclosure.

Examples of computational operations 512 include one or more computer systems 520 that include one or more processors and computer-readable media (e.g., non-transitory computer-readable media) operatively coupled to the one or more processors to execute computer operations to perform the methods of the present disclosure. The computational operations 512 can be implemented using one or more databases 518, which store data received from the field operations 510 and/or generated internally within the computational operations 512 (e.g., by implementing the methods of the present disclosure) or both. For example, the one or more computer systems 520 process inputs from the field operations 510 to assess conditions in the physical world, the outputs of which are stored in the databases 518. For example, seismic sensors of the field operations 510 can be used to perform a seismic survey to map subterranean features, such as facies and faults. In performing a seismic survey, seismic sources (e.g., seismic vibrators or explosions) generate seismic waves that propagate in the earth and seismic receivers (e.g., geophones) measure reflections generated as the seismic waves interact with boundaries between layers of a subsurface formation. The source and received signals are provided to the computational operations 512 where they are stored in the databases 518 and analyzed by the one or more computer systems 520.

In some implementations, one or more outputs 522 generated by the one or more computer systems 520 can be provided as feedback/input to the field operations 510 (either as direct input or stored in the databases 518). The field operations 510 can use the feedback/input to control physical components used to perform the field operations 510 in the real world.

For example, the computational operations 512 can process the seismic data to generate three-dimensional (3D) maps of the subsurface formation. The computational operations 512 can use these 3D maps to provide plans for locating and drilling exploratory wells. In some operations, the exploratory wells are drilled using logging-while-drilling (LWD) techniques which incorporate logging tools into the drill string. LWD techniques can enable the computational operations 512 to process new information about the formation and control the drilling to adjust to the observed conditions in real-time.

The one or more computer systems 520 can update the 3D maps of the subsurface formation as information from one exploration well is received and the computational operations 512 can adjust the location of the next exploration well based on the updated 3D maps. Similarly, the data received from production operations can be used by the computational operations 512 to control components of the production operations. For example, production well and pipeline data can be analyzed to predict slugging in pipelines leading to a refinery and the computational operations 512 can control machine operated valves upstream of the refinery to reduce the likelihood of plant disruptions that run the risk of taking the plant offline.

In some implementations of the computational operations 512, customized user interfaces can present intermediate or final results of the above-described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or app), or at a central processing facility.

The presented information can include feedback, such as changes in parameters or processing inputs, that the user can select to improve a production environment, such as in the exploration, production, and/or testing of petrochemical processes or facilities. For example, the feedback can include parameters that, when selected by the user, can cause a change to, or an improvement in, drilling parameters (including drill bit speed and direction) or overall production of a gas or oil well. The feedback, when implemented by the user, can improve the speed and accuracy of calculations, streamline processes, improve models, and solve problems related to efficiency, performance, safety, reliability, costs, downtime, and the need for human interaction.

In some implementations, the feedback can be implemented in real-time, such as to provide an immediate or near-immediate change in operations or in a model. The term real-time (or similar terms as understood by one of ordinary skill in the art) means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second(s), or less than 5 s. While the requested data need not be displayed (or initiated for display) instantaneously, it is displayed (or initiated for display) without any intentional delay, considering processing limitations of a described computing system and time required to, for example, gather, accurately measure, analyze, process, store, or transmit the data.

Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart or are in different countries or other jurisdictions.

The preceding figures and accompanying description illustrate example processes and computer implementable techniques. The environments and systems described above (or their software or other components) can contemplate using, implementing, or executing any suitable technique for performing these and other tasks. It will be understood that these processes are for illustration purposes only and that the described or similar techniques can be performed at any appropriate time, including concurrently, individually, in parallel, and/or in combination. In addition, many of the operations in these processes can take place simultaneously, concurrently, in parallel, and/or in different orders than as shown. Moreover, processes can have additional operations, fewer operations, and/or different operations, so long as the methods remain appropriate.

In other words, although the disclosure has been described in terms of certain implementations and generally associated methods, alterations and permutations of these implementations, and methods will be apparent to those skilled in the art. Accordingly, the above description of example implementations does not define or constrain the disclosure. Other changes, substitutions, and alterations are also possible without departing from the spirit and scope of the disclosure.

A number of implementations of the present disclosure have been described. Nevertheless, it will be understood that various modifications can be made without departing from the spirit and scope of the present disclosure. Accordingly, other implementations are within the scope of the following claims.

In view of the above-described implementations of subject matter this application discloses the following list of examples, wherein one feature of an example in isolation or more than one feature of said example taken in combination and, optionally, in combination with one or more features of one or more further examples are further examples also falling within the disclosure of this application.

Example 1. A computer-implemented method comprising: receiving, by one or more processors from probes, thermodynamic data indicative of surface conditions and subterranean conditions of a subterranean region comprising a well; receiving, by the one or more processors from a pH meter, an acidity of a produced water stream to be disposed in the well; determining, by the one or more processors, by using the thermodynamic data, a supersaturation degree of the produced water stream to be disposed in the well; determining, by the one or more processors, by using the supersaturation degree and the acidity, an amount of carbon dioxide to be injected in the produced water stream to neutralize a scaling risk; and triggering, by the one or more processors, an injection of the amount of the carbon dioxide in the produced water stream to neutralize the scaling risk.

Example 2. The computer-implemented method of the preceding example, wherein determining the supersaturation degree of the produced water stream comprises determining a saturation ratio of the fluid.

Example 3. The computer-implemented method of any of the preceding examples, wherein probe data comprises temperature, pressure data, and flow data.

Example 4. The computer-implemented method of any of the preceding examples, wherein the pH meter is located at least about 60 meters after a mixture point.

Example 5. The computer-implemented method of any of the preceding examples, wherein the scaling risk comprises formation of calcium carbonate.

Example 6. The computer-implemented method of any of the preceding examples, wherein the amount of the carbon dioxide is injected in the produced water stream in a liquid phase or a supercritical phase.

Example 7. The computer-implemented method of any of the preceding examples, wherein the produced water stream is filtered to remove oil and heavy particles.

Example 8. The computer-implemented method of any of the preceding examples, wherein the produced water stream comprises ion components comprising sodium ($Na^+$), chloride ($Cl^-$), calcium ($Ca^{2+}$), magnesium ($Mg^{2+}$), bicarbonate ($HCO_3^-$), and sulfate ($SO_4^{2-}$).

Example 9. A computer-implemented system comprising: memory storing application programming interface information; and a server performing operations comprising: receiving, by one or more processors from probes, thermodynamic data indicative of surface conditions and subterranean conditions of a subterranean region comprising a well; receiving, by the one or more processors from a pH meter, an acidity of a produced water stream to be disposed in the well; determining, by the one or more processors, by using the thermodynamic data, a supersaturation degree of the produced water stream to be disposed in the well; determining, by the one or more processors, by using the supersaturation degree and the acidity, an amount of carbon dioxide to be injected in the produced water stream to neutralize a scaling risk; and triggering, by the one or more processors, an injection of the amount of the carbon dioxide in the produced water stream to neutralize the scaling risk.

Example 10. The computer-implemented system of the preceding example, wherein determining the supersaturation degree of the produced water stream comprises determining a saturation ratio of the fluid.

Example 11. The computer-implemented system of any of the preceding examples, wherein probe data comprises temperature, pressure data, and flow data.

Example 12. The computer-implemented system of any of the preceding examples, wherein the pH meter is located at least about 60 meters after a mixture point.

Example 13. The computer-implemented system of any of the preceding examples, wherein the scaling risk comprises formation of calcium carbonate.

Example 14. The computer-implemented system of any of the preceding examples, wherein the amount of the carbon dioxide is injected in the produced water stream in a liquid phase or a supercritical phase.

Example 15. The computer-implemented system of any of the preceding examples, wherein the produced water stream is filtered to remove oil and heavy particles.

Example 16. The computer-implemented system of any of the preceding examples, wherein the produced water stream comprises ion components comprising sodium (Na+), chloride (Cl−), calcium (Ca2+), magnesium (Mg2+), bicarbonate (HCO3−), and sulfate (SO42−).

Example 17. A non-transitory computer-readable media encoded with a computer program, the computer program comprising instructions that when executed by one or more computers cause the one or more computers to perform operations comprising: receiving, by one or more processors from probes, thermodynamic data indicative of surface conditions and subterranean conditions of a subterranean region comprising a well; receiving, by the one or more processors from a pH meter, an acidity of a produced water stream to be disposed in the well; determining, by the one or more processors, by using the thermodynamic data, a supersaturation degree of the produced water stream to be disposed in the well; determining, by the one or more processors, by using the supersaturation degree and the acidity, an amount of carbon dioxide to be injected in the produced water stream to neutralize a scaling risk; and triggering, by the one or more processors, an injection of the amount of the carbon dioxide in the produced water stream to neutralize the scaling risk.

Example 18. The non-transitory computer-readable media of the preceding example, wherein determining the supersaturation degree of the produced water stream comprises determining a saturation ratio of the fluid.

Example 19. The non-transitory computer-readable media of any of the preceding examples7, wherein probe data comprises temperature, pressure data, and flow data, wherein the pH meter is located at least about 60 meters after a mixture point, wherein the scaling risk comprises formation of calcium carbonate, and wherein the amount of the carbon dioxide is injected in the produced water stream in a liquid phase or a supercritical phase.

Example 20. The non-transitory computer-readable media of any of the preceding examples7, wherein the produced water stream is filtered to remove oil and heavy particles, and wherein the produced water stream comprises ion components comprising sodium (Na+), chloride (Cl−), calcium (Ca2+), magnesium (Mg2+), bicarbonate (HCO3−), and sulfate (SO42−).

What is claimed is:

1. A computer-implemented method comprising:

receiving, by one or more processors from probes, thermodynamic data indicative of surface conditions and subterranean conditions of a subterranean region comprising a well;

receiving, by the one or more processors from a pH meter, an acidity of a produced water stream to be disposed in the well;

determining, by the one or more processors, by using the thermodynamic data, a supersaturation degree of the produced water stream to be disposed in the well;

determining, by the one or more processors, by using the supersaturation degree and the acidity, an amount of carbon dioxide to be injected in the produced water stream to neutralize a scaling risk; and triggering, by the one or more processors, an injection of the amount of the carbon dioxide in the produced water stream to neutralize the scaling risk.

2. The computer-implemented method of claim 1, wherein determining the supersaturation degree of the produced water stream comprises determining a saturation ratio of the produced water stream.

3. The computer-implemented method of claim 1, wherein probe data comprises temperature, pressure data, and flow data.

4. The computer-implemented method of claim 1, wherein the pH meter is located at least about 60 meters after a mixture point.

5. The computer-implemented method of claim 1, wherein the scaling risk comprises formation of calcium carbonate.

6. The computer-implemented method of claim 1, wherein the amount of the carbon dioxide is injected in the produced water stream in a liquid phase or a supercritical phase.

7. The computer-implemented method of claim 1, wherein the produced water stream is filtered to remove oil and heavy particles.

8. The computer-implemented method of claim 1, wherein the produced water stream comprises ion components comprising sodium ($Na^+$), chloride ($Cl^-$), calcium ($Ca^{2+}$), magnesium ($Mg^{2+}$), bicarbonate ($HCO^{3-}$), and sulfate ($SO_4^{2-}$).

* * * * *